US011514847B2

(12) United States Patent
Ban et al.

(10) Patent No.: US 11,514,847 B2
(45) **Date of Patent: *Nov. 29, 2022**

(54) DISPLAY DEVICE AND METHOD OF DRIVING THE SAME

(71) Applicant: Samsung Display Co., Ltd., Yongin-Si (KR)

(72) Inventors: Seok Gyu Ban, Yongin-si (KR); Kyung Man Kim, Yongin-si (KR); Wook Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

This patent is subject to a terminal disclaimer.

(21) Appl. No.: 17/475,617

(22) Filed: Sep. 15, 2021

(65) Prior Publication Data

US 2021/0407387 A1 Dec. 30, 2021

Related U.S. Application Data

(63) Continuation of application No. 17/009,676, filed on Sep. 1, 2020, now Pat. No. 11,145,244.

(30) Foreign Application Priority Data

Oct. 30, 2019 (KR) ..... 10-2019-0136731

(51) Int. Cl.
*G09G 3/32* (2016.01)

(52) U.S. Cl.
CPC ..... *G09G 3/32* (2013.01); *G09G 2310/027* (2013.01); *G09G 2310/08* (2013.01); *G09G 2320/0276* (2013.01)

(58) Field of Classification Search
CPC ..... G09G 2310/027; G09G 2310/08; G09G 2320/0276; G09G 3/32
See application file for complete search history.

(56) References Cited

U.S. PATENT DOCUMENTS

| | | | |
|---|---|---|---|
| 9,824,634 | B2 | 11/2017 | Miwa et al. |
| 2011/0216056 | A1 | 9/2011 | Yoo et al. |
| 2015/0379937 | A1 | 12/2015 | Kim et al. |
| 2017/0076656 | A1 | 3/2017 | Bang |
| 2017/0084227 | A1 | 3/2017 | Bae et al. |

FOREIGN PATENT DOCUMENTS

KR 10-2017-0021678 A 2/2017

*Primary Examiner* — Muhammad N Edun
(74) *Attorney, Agent, or Firm* — Innovation Counsel LLP

(57) ABSTRACT

A display device includes a display unit, a timing controller, a data driver, and a sensing unit. The display unit includes a data line, a sensing line, and a pixel that includes a light emitting element and a transistor for providing a driving current to the light emitting element. The timing controller generates a first voltage value by compensating a first grayscale value and generates a second voltage value by remapping the first voltage value from a first voltage range to in a second voltage range. The data driver generates a data voltage based on the second voltage value and supplies the data voltage to the data line. The sensing unit provides an initialization voltage to the sensing line. A voltage difference between the data voltage and a threshold voltage of the transistor is greater than or equal to the initialization voltage.

16 Claims, 7 Drawing Sheets

DISPLAY DEVICE AND METHOD OF DRIVING THE SAME

CROSS-REFERENCE TO RELATED APPLICATION

This application is continuation application of U.S. patent application Ser. No. 17/009,676 filed Sep. 1, 2020, which claims priority to and the benefit of Korean Patent Application No. 10-2019-0136731, filed Oct. 30, 2019, the disclosures of which are hereby incorporated by reference herein in their entirety.

BACKGROUND

Field

Embodiments of the present disclosure relate to a display device and a method of driving the same.

Discussion

A display device includes a display panel and a driving unit. The display panel includes scan lines, data lines, and pixels. The driving unit includes a scan driver that sequentially provides scan signals to the scan lines and a data driver that provides data signals to the data lines. Each of the pixels may emit light at a luminance corresponding to a data signal provided through a corresponding data line in response to a scan signal provided through a corresponding scan line.

The display device displays an image through the pixels, and each of the pixels may include a light emitting element and a driving transistor for providing a driving current to the light emitting element.

Light emitting characteristics of the pixels may deviate due to a process variation. The display device may compensate for the data signal or a grayscale value corresponding to the data signal by using an offset value that may be set during a manufacturing process, so that the pixels of the display device may emit light uniformly.

The light emitting element including an organic light emitting diode may deteriorate depending on a usage time. The display device may employ a deterioration compensation technique to compensate for the data signal (or the grayscale value). Accordingly, the display device may prevent, mitigate, and/or compensate for deterioration of the light emitting element.

In addition, the display device may compensate for a change in light emitting characteristic of each pixel using an external compensation technique based on a sensed threshold voltage information and/or mobility information of the driving transistor of the pixel or deterioration information of the light emitting element of the pixel.

SUMMARY

In a display device that employs both a deterioration compensation technique, and an external compensation technique, an external compensation value such as a compensation value for a data signal obtained by the external compensation technique may be canceled by a deterioration compensation value. As a result, a pixel may not emit light at a desired luminance. In particular, in a low grayscale range (e.g., in a low grayscale range corresponding to relatively small grayscale values) that is sensitive to a change in light emitting characteristic (e.g., grayscale-voltage characteristic) of a pixel, light emitting characteristic of the pixel compensated by the compensation techniques may greatly deviate from light emission characteristic of a normal pixel, and linearity of the light emitting characteristic of the pixel may be degraded or lost.

The present disclosure provides a display device and a method of driving the same that can prevent compensation by the external compensation technique from being degraded by the deterioration compensation techniques and obtain the linearity of the light emitting characteristic of the pixel in a low grayscale range.

The display device according to embodiments of the present disclosure may include a display unit including a data line, a sensing line, and a pixel connected to the data line and the sensing line, the pixel including a light emitting element and a first transistor for providing a driving current to the light emitting element; a timing controller generating a first voltage value by compensating for a first grayscale value and generating a second voltage value by remapping the first voltage value; a data driver generating a data voltage based on the second voltage value and supplying the data voltage to the data line in a display period; and a sensing unit providing an initialization voltage to the sensing line in the display period and sensing a threshold voltage of the first transistor through the sensing line in a sensing period. The timing controller may remap the first voltage value that is in a first voltage range to the second voltage value that is in a second voltage range, and a voltage difference between the data voltage and the threshold voltage of the first transistor is greater than or equal to the initialization voltage.

According to an embodiment, the second voltage range may be a subset of the first voltage range.

According to an embodiment, a minimum voltage value of the second voltage range may be greater than a minimum voltage value of the first voltage range, and a maximum voltage value of the second voltage range may be equal to a maximum voltage value of the first voltage range.

According to an embodiment, a voltage greater than or equal to zero may be applied between a gate electrode and a source electrode of the first transistor according to the data voltage.

According to an embodiment, for the first grayscale value being a minimum grayscale value corresponding to a black color, the voltage difference between the data voltage with respect to the first grayscale value and the threshold voltage of the first transistor may be equal to the initialization voltage.

According to an embodiment, the pixel may include a second transistor connected between the data line and a first node; a storage capacitor connected between the first node and a second node; and a third transistor connected between the second node and the sensing line. An electrode of the light emitting element may be connected to the second node. The first transistor may provide the driving current to the second node in response to a voltage of the first node.

According to an embodiment, the first transistor may include an oxide semiconductor.

According to an embodiment, the timing controller may include a first compensation circuit converting the first grayscale value to a first grayscale voltage value according to a reference gamma curve; a second compensation circuit calculating the first voltage value by adding the first grayscale voltage value and a compensation value; a third compensation circuit calculating the second voltage value by remapping the first voltage value from the first voltage range to the second voltage range; and a fourth compensation circuit compensating and outputting the second voltage value based on the threshold voltage of the first transistor.

The compensation value may be preset based on a characteristic deviation of the pixel or may be calculated based on a level of deterioration of the pixel.

According to an embodiment, the compensation value may be smaller than zero, and the first voltage value may be smaller than the first grayscale voltage value.

According to an embodiment, the third compensation circuit may scale the first voltage value and shift a scaled first voltage value within the second voltage range.

According to an embodiment, the third compensation circuit may map a minimum voltage value of the first voltage range to a voltage value corresponding to a sum of the initialization voltage and the threshold voltage of the first transistor.

According to an embodiment, for the first voltage value being smaller than the sum of the initialization voltage and the threshold voltage of the first transistor, the third compensation circuit may map the first voltage value to the voltage value corresponding to the sum of the initialization voltage and the threshold voltage of the first transistor.

According to an embodiment, the third compensation circuit may remap the first voltage value to the second voltage value using a lookup table.

According to one embodiment, a display device according to embodiments of the present disclosure may include a display unit including a data line, a sensing line, and a pixel connected to the data line and the sensing line, the pixel including a light emitting element and a transistor for providing a driving current to the light emitting element; a timing controller generating a first voltage value by compensating for a first grayscale value and generating a second voltage value by remapping the first voltage value; a data driver generating a data voltage based on the second voltage value and supplying the data voltage to the data line; and a sensing unit providing an initialization voltage to the sensing line. The timing controller may remap the first voltage value that is in a first voltage range to the second voltage value that is in a second voltage range, and a voltage difference between the data voltage and a threshold voltage of the transistor is greater than or equal to the initialization voltage.

According to one embodiment, a method according to embodiments of the present disclosure may drive a display device that includes a data line, a sensing line, and a pixel connected to the data line and the sensing line, and the pixel includes a light emitting element and a transistor for providing a driving current to the light emitting element. The method may include converting a first grayscale value for the pixel into a first grayscale voltage value according to a reference gamma curve; calculating a first voltage value by adding the first grayscale voltage value and a compensation value; calculating a second voltage value by remapping the first voltage value from a first voltage range to a second voltage range; generating a compensated second voltage value by compensating the second voltage value based on a threshold voltage of the transistor; and providing an initialization voltage to the pixel through the sensing line and a data voltage that is generated based on the compensated second voltage value to the pixel through the data line. The compensation value may be preset based on a characteristic deviation of the pixel or may be calculated based on a level of deterioration of the pixel. The calculating the second voltage value may include remapping the first voltage value to the second voltage value, and a voltage difference between the data voltage and the threshold voltage of the first transistor may be greater than or equal to the initialization voltage.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
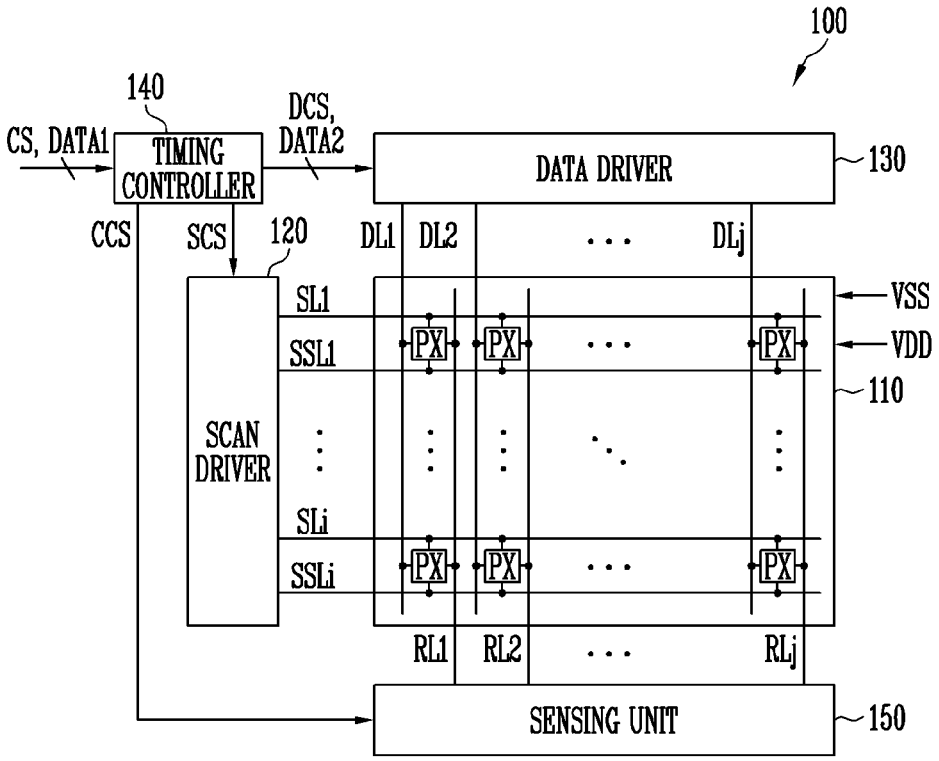
FIG. 1 is a block diagram illustrating a display device according to embodiments of the present disclosure.

The present disclosure may be modified in various ways and may have various forms and configurations, and specific embodiments will be illustrated in the drawings and described in detail herein. However, the present disclosure is not limited to the embodiments disclosed herein, and may be modified and carried out in various different forms and configurations.

In the drawings, some components that are not directly related to a characteristic of the present disclosure may be omitted to clearly illustrate the present disclosure. In addition, some components in the drawings may be shown to be exaggerated in size, ratio, and the like. Throughout the drawings, the same or similar components are denoted by the same reference numerals and symbols even though they may be shown in different drawings, and repetitive descriptions will be omitted.

FIG. 1 is a block diagram illustrating a display device according to embodiments of the present disclosure.

Referring to FIG. 1, a display device 100 may include a display unit 110 (or a display panel), a scan driver 120 (or a gate driver), a data driver 130 (or a source driver), a timing controller 140, and a sensing unit 150 (or a sensing circuit).

The display unit 110 may include scan lines SL1 to SLi, data lines DL1 to DLj, and pixels PX, wherein i and j are positive integers. In addition, the display unit 110 may further include sensing control lines SSL1 to SSLi and sensing lines RL1 to RLj (or lead-out lines).

The pixels PX may be provided in a region (e.g., a pixel region) partitioned by the scan lines SL1 to SLi and the data lines DL1 to DLj.

Each of the pixels PX may be electrically connected to one of the scan lines SL1 to SLi and one of the data lines DL1 to DLj. In addition, each of the pixels PX may be electrically connected to one of the sensing control lines SSL1 to SSLi and one of the sensing lines RL1 to RLj. Each of the pixels PX may include a light emitting element and at least one transistor for providing a driving current to the light emitting element.

The pixel PX may emit light at a luminance corresponding to a data voltage (or a data signal) provided through a data line in response to a scan signal provided through a scan line. In addition, the pixel PX may output characteristic information (or deterioration information, for example, a sensing voltage or a sensing current) of the light emitting element through a sensing line in response to a sensing control signal provided through a sensing control line.

A detailed configuration and operation of the pixel PX will be described later with reference to FIG. 2.

The display unit 110 may be provided with a first power source voltage VDD and a second power source voltage VSS. The first and second power source voltages VDD and VSS are used to operate the pixels PX. The first power source voltage VDD may have a voltage level higher than that of the second power source voltage VSS. The first and second power source voltages VDD and VSS may be provided to the display unit 110 from an external power supply unit.

The scan driver 120 may generate the scan signal based on a scan control signal SCS and sequentially provide the scan signal to the scan lines SL1 to SLi. Here, the scan control signal SCS may include a start signal (or a start pulse), clock signals, and the like, and may be provided from the timing controller 140. For example, the scan driver 120 may include a shift register (or a stage) that sequentially generates and outputs the scan signal having a pulse shape corresponding to the start signal having a pulse shape using the clock signals.

Similar to the scan signal, the scan driver 120 may further generate the sensing control signal and provide the sensing control signal to the sensing control lines SSL1 to SSLi.

The data driver 130 may generate data voltages (or data signals) based on image data DATA2 (or a compensated grayscale value) and a data control signal DCS provided from the timing controller 140, and provide the data voltages to the data lines DL1 to DLj. Here, the data control signal DCS is a signal for controlling an operation of the data driver 130 and may include a load signal (or a data enable signal) indicating an output of an effective data voltage.

In an embodiment, the data driver 130 may generate the data voltage corresponding to a data value (a grayscale value or a digital voltage value) included in the image data DATA2 using gamma voltages. Here, the gamma voltages may be generated by the data driver 130 or may be provided from a separate gamma voltage generation circuit (e.g., a gamma integrated circuit). The data driver 130 may select one of the gamma voltages based on the data value and output it as the data voltage.

The sensing unit 150 may provide an initialization voltage to the sensing lines RL1 to RLj in a display period, and sense light emitting characteristic of the pixel PX through the sensing lines RL1 to RLj in a sensing period. Here, the display period may correspond to a period during which the data voltage is provided or written to the pixel PX, and the pixel PX emits light, and the sensing period may correspond to a period allocated before or after the display period to sense the light emitting characteristic of the pixel PX. The display period and the sensing period may be included in one frame (or a frame period). The light emitting characteristic of the pixel PX may include a threshold voltage and mobility of at least one transistor (e.g., a driving transistor) and characteristic information (e.g., a degree of deterioration) of the light emitting element in the pixel PX. For example, the sensing unit 150 may detect a sensing value (e.g., a sensing voltage or a sensing current) corresponding to the light emitting characteristic of the pixel PX through the sensing lines RL1 to RLj.

The sensing value may be provided to the timing controller 140, and the timing controller 140 may compensate for the image data DATA2 (or input image data DATA1) based on the sensing value. However, the present disclosure is not limited thereto. For example, the sensing unit 150 may provide the sensing value to the data driver 130, and the data driver 130 may generate the data voltage based on the sensing value. In this case, the data driver 130 may vary or compensate for the data voltage based on the amount of a change in the sensing value. The data voltage may be compensated based on the light emitting characteristic (or a change in the light emitting characteristic) of the corresponding pixel PX.

The timing controller 140 may receive the input image data DATA1 and a control signal CS from an external device (e.g., a graphic processor), generate the scan control signal SCS and the data control signal DCS based on the control signal CS, and convert the input image data DATA1 to generate the image data DATA2. Here, the control signal CS may include a vertical synchronization signal, a horizontal synchronization signal, a clock signal, and the like. For example, the timing controller 140 may convert the input image data DATA1 into the image data DATA2 having a format usable by the data driver 130.

In addition, the timing controller 140 may generate a compensation control signal CCS based on the control signal CS. The compensation control signal CCS may be provided to the sensing unit 150.

In an embodiment, the timing controller 140 may convert a first grayscale value included in the input image data DATA1 into a first voltage value based on a deterioration compensation technique and an external compensation technique. Here, the first voltage value may correspond to the data value representing the data voltage corresponding to the first grayscale value.

In an embodiment, the timing controller 140 may map (or remap) the first voltage value from a first voltage range (or a first grayscale voltage range) to a second voltage range (or a second grayscale voltage range) so that a voltage difference between the data voltage and the threshold voltage of the driving transistor included in the pixel PX is greater than or equal to the initialization voltage. Here, the threshold voltage of the driving transistor may be sensed through the sensing unit 150 in the sensing period, and the initialization voltage may be provided to the pixel PX through the sensing unit 150 in the display period. The second voltage range may be a subset of the first voltage range. A minimum voltage value of the second voltage range may be greater than a minimum voltage value of the first voltage range, and a maximum voltage value of the second voltage range may be equal to a maximum voltage value of the first voltage range.

For example, the voltage difference between the data voltage corresponding to a minimum grayscale value (e.g., a grayscale value corresponding to a black color, or a grayscale value of 0) and the threshold voltage of the driving transistor may be equal to the initialization voltage.

For reference, the deterioration compensation technique predicts and compensates for a change in the light emitting characteristic of the pixel PX by using a lookup table including a fixed gain and an offset, and the external compensation technique compensates for the change in the light emitting characteristic of the pixel PX by using a value that is actually sensed by the sensing unit 150. According to an embodiment of the present disclosure, the display device 100 may sequentially compensate for the voltage value (or the grayscale value) using the deterioration compensation technique, and the external compensation technique. In addition, in order for the data voltage to be compensated normally through the external compensation technique, the display device 100 may remap the compensated voltage value to a reference voltage range (that is, a voltage range corresponding to a case where the voltage difference between the data voltage and the threshold voltage of the driving transistor is greater than or equal to the initialization voltage) through the deterioration compensation technique. For example, the display device 100 may remap a minimum voltage value compensated by the deterioration compensation technique to the sum (that is, a total voltage) of the threshold voltage of the driving transistor and the initialization voltage. In this case, grayscale values in a low grayscale range can be accurately compensated by the external compensation technique, and linearity of the light emitting characteristic of the pixel PX in the low grayscale range can be obtained.

As described with reference to FIG. 1, the display device 100 (or the timing controller 140) may generate the first voltage value by sequentially compensating the grayscale value using the deterioration compensation technique and the external compensation technique. In addition, the display device 100 may remap the first voltage value in the first voltage range to the second voltage value in the second voltage range so that the voltage difference between the data voltage and the threshold voltage of the driving transistor is greater than or equal to the initialization voltage before compensating the first voltage value using the external compensation technique. Accordingly, compensation for a change in the light emitting characteristic of the pixel PX by the external compensation technique can be maintained, and the linearity of the light emitting characteristic of the pixel in the low grayscale range can be obtained.

At least one of the scan driver 120, the data driver 130, the timing controller 140, and the sensing unit 150 may be formed on the display unit 110, or may be implemented as an integrated circuit (IC) and mounted on a flexible circuit board and connected to the display unit 110. In addition, at least two of the scan driver 120, the data driver 130, the timing controller 140, and the sensing unit 150 may be implemented as a single IC.

Figure 2:
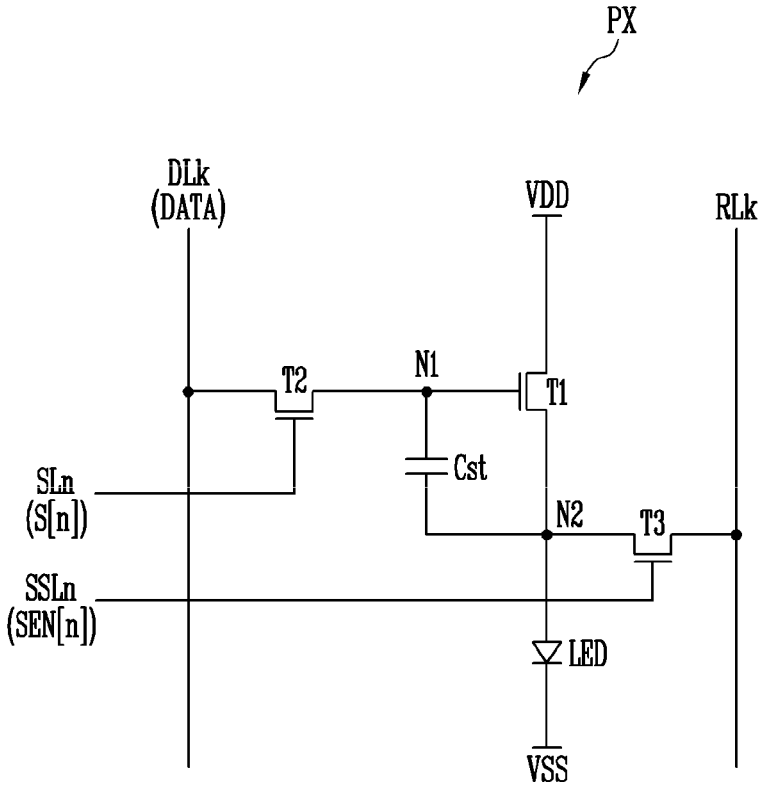
FIG. 2 is a circuit diagram illustrating an example of a pixel included in the display device of FIG. 1.

FIG. 2 is a circuit diagram illustrating an example of a pixel included in the display device 100 of FIG. 1.

Referring to FIG. 2, the pixel PX may be connected to an n-th scan line SLn, a k-th data line DLk, an n-th sensing control line SSLn, and a k-th sensing line RLk (where n and k are positive integers).

The pixel PX may include a light emitting element LED, a first transistor T1 (herein also referred to as a driving transistor), a second transistor T2 (herein also referred to as a switching transistor), a third transistor T3 (herein also referred to as a sensing transistor), and a storage capacitor Cst. Each of the first transistor T1, the second transistor T2, and the third transistor T3 may be a thin film transistor including an oxide semiconductor.

An anode electrode of the light emitting element LED may be connected to a second node N2 (or a second electrode of the first transistor T1), and a cathode electrode of the light emitting element LED may be connected to a second power source line to which the second power source voltage VSS is applied. The light emitting element LED may generate light having a predetermined luminance in response to the amount of current (or a driving current) supplied from the first transistor T1. The light emitting element LED may be an organic light emitting diode, but the present disclosure is not limited thereto. For example, the light emitting element LED may include an inorganic light emitting diode.

A first electrode of the first transistor T1 may be connected to a first power source line to which the first power source voltage VDD is applied, and the second electrode of the first transistor T1 may be connected to a second node N2 (or the anode electrode of the light emitting element LED). A gate electrode of the first transistor T1 may be connected to the first node N1. The first transistor T1 may control the amount of current flowing to the light emitting element LED in response to a voltage of the first node N1.

A first electrode of the second transistor T2 may be connected to the k-th data line DLk, and a second electrode of the second transistor T2 may be connected to the first node N1. A gate electrode of the second transistor T2 may be connected to the n-th scan line SLn. When a scan signal S[n] is supplied to the n-th scan line SLn, the second transistor T2 may be turned on to transfer a data voltage DATA (or a data signal) from the k-th data line DLk to the first node N1.

The storage capacitor Cst may be connected between the first node N1 and the anode electrode of the light emitting element LED. The storage capacitor Cst may store the voltage of the first node N1.

The third transistor T3 may be connected between the k-th sensing line RLk and the second node N2 (or the second electrode of the first transistor T1). The third transistor T3 may connect the second node N2 and the k-th sensing line RLk in response to a sensing control signal SEN[n] supplied to the n-th sensing control line SSLn. A sensing voltage (or a node voltage of the second node N2) may be provided to the k-th sensing line RLk through the third transistor T3 based on the sensing control signal SEN[n]. However, the present disclosure is not limited thereto. For example, a sensing current corresponding to a node voltage of the second node N2 may be transferred to the k-th sensing line RLk. In the present embodiment, the sensing voltage may be provided to the sensing unit 150 (refer to FIG. 1) through the k-th sensing line RLk.

In the embodiment of the present disclosure, the pixel PX is not limited to the circuit structure shown in FIG. 2, and the pixel PX may have various other circuit structures without departing from the scope of the present disclosure.

Figure 3:
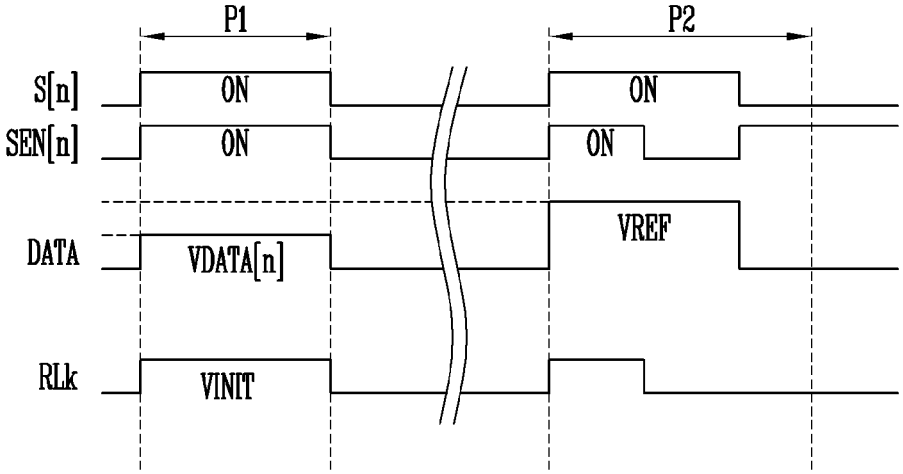
FIG. 3 is a waveform diagram illustrating an example of signals measured in the pixel of FIG. 2.

FIG. 3 may be referred to for describing an operation of the pixel PX of FIG. 2.

FIG. 3 is a waveform diagram illustrating an example of signals measured in the pixel PX of FIG. 2.

Referring to FIGS. 2 and 3, a first period P1 (or the display period) may correspond to a period in which the pixel PX emits light and/or a period in which a valid data voltage is applied (or written) to the pixel PX so that the pixel PX emits light. A second period P2 (or the sensing period) may correspond to a period in which characteristic of the light emitting element in the pixel PX is sensed, and the pixel PX may not emit light in the second period P2. The first period P1 and the second period P2 may be included in one frame section (e.g., a section in which one frame image is displayed). Although FIG. 3 shows that the first period P1 is located before the second period P2, the present disclosure is not limited thereto. For example, within one frame section, the second period P2 may be located before the first period P1.

In the first period P1, the scan signal S[n] may have a gate-on voltage level ON, and the sensing control signal SEN[n] may have the gate-on voltage level ON. Here, the gate-on voltage level ON may correspond to a voltage level for turning on the transistor. The data voltage DATA in the k-th data line DLk may have an n-th data voltage level VDATA[n].

In the first period P1, the second transistor T2 of the pixel PX may be turned on in response to the scan signal S[n] having the gate-on voltage level ON, and the data voltage DATA of the n-th data voltage level VDATA[n] may be applied to the first node N1. In addition, the third transistor T3 of the pixel PX may be turned on in response to the sensing control signal SEN[n] of the gate-on voltage level ON, and an initialization voltage VINIT applied to the k-th sensing line RLk may be provided to the second node N2 through the third transistor T3. Here, the initialization voltage VINIT may have a voltage level lower than an operating voltage level (e.g., a threshold voltage level) of the light emitting element LED. Therefore, a voltage corresponding to the difference between the data voltage DATA at the first node N1 and the initialization voltage VINIT at the second node N2 (that is, the data voltage at which the threshold voltage of the first transistor T1 is compensated) may be stored in the storage capacitor Cst. The amount of driving current flowing through the first transistor T1 may be determined according to the voltage stored in the storage capacitor Cst. When the sensing control signal SEN[n] switches from the gate-on voltage level ON to a gate-off voltage level OFF in the first period P1, the light emitting element LED may emit light at a luminance corresponding to the amount of driving current.

In the second period P2, the scan signal S[n] may partially have the gate-on voltage level ON, and the sensing control signal SEN[n] may partially have the gate-on voltage level ON and the gate-off voltage level OFF. In at least a portion of the second period P2, the data voltage DATA in the k-th data line DLk may have a reference voltage level VREF.

In the second period P2, the second transistor T2 of the pixel PX may be turned on in response to the scan signal S[n] having the gate-on voltage level ON, and the data voltage DATA of the reference voltage level VREF may be applied to the first node N1. The third transistor T3 of the pixel PX may be turned on in response to the sensing control signal SEN[n] having the gate-on voltage level ON. In the portion of the second period P2 in which the sensing control signal SEN[n] has the gate-on voltage level ON, the initialization voltage VINIT is applied to the k-th sensing line RLk, and the initialization voltage VINIT may be applied to the second node N2 through the third transistor T3.

When the sensing control signal SEN[n] switches from the gate-on voltage level ON the gate-off voltage level OFF, a voltage corresponding to the threshold voltage of the first transistor T1 and the operating voltage level (e.g., the threshold voltage) of the light emitting element LED may be stored in the storage capacitor Cst. Subsequently, when the scan signal S[n] switches from the gate-on voltage level ON to the gate-off voltage level OFF, and the sensing control signal SEN[n] has the gate-on voltage level ON, a current corresponding to the operating voltage level of the light emitting element LED may flow through the third transistor T3 to the k-th sensing line RLk.

Figure 4:
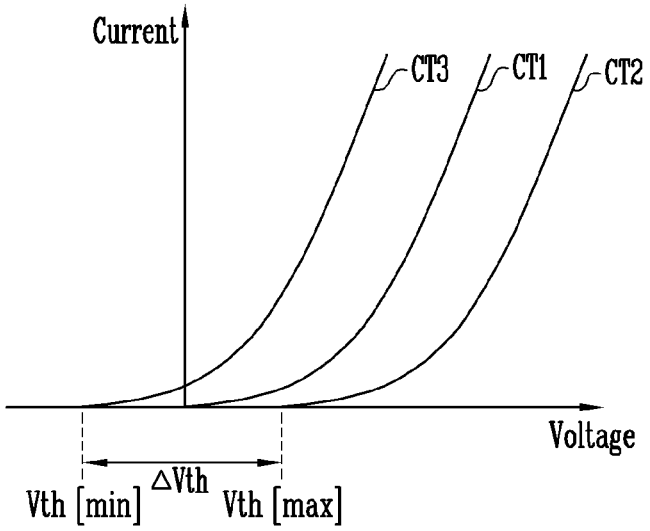
FIG. 4 is a graph illustrating voltage-current characteristics of a first transistor included in the pixel of FIG. 2.

FIG. 4 is a graph illustrating voltage-current characteristics of the first transistor T1 included in the pixel of FIG. 2.

Referring to FIGS. 2 and 4, a first characteristic curve CT1 represents a current-voltage characteristic of the first transistor T1. A second characteristic curve CT2 represents the current-voltage characteristic of the first transistor T1 when a threshold voltage Vth of the first transistor T1 is shifted in a positive direction. In this case, the threshold voltage Vth of the first transistor T1 according to the second characteristic curve CT2 may be expressed as a maximum threshold voltage Vth[max]. A third characteristic curve CT3 represents the current-voltage characteristic of the first transistor T1 when the threshold voltage Vth of the first transistor T1 is shifted in a negative direction. The threshold voltage Vth of the first transistor T1 according to the third characteristic curve CT3 may be expressed as a minimum threshold voltage Vth[min] A difference between the maximum threshold voltage Vth[max] and the minimum threshold voltage Vth[min] may be expressed as "ΔVth". During the use of the pixel PX (or the display device 100 shown in FIG. 1), the threshold voltage Vth of the first transistor T1 may vary with a deviation of ΔVth.

The display device 100 may adjust the data voltage DATA and the initialization voltage VINIT so that the luminance corresponding to the black color is 0 nit (a unit of measurement of luminance). For example, the display device 100 may measure the threshold voltage Vth of the first transistor T1 using the external compensation technique, and adjust the data voltage DATA so that the difference between the data voltage corresponding to the black color (e.g., the data voltage corresponding to a grayscale value of 0) and the threshold voltage Vth of the first transistor T1 is equal to the initialization voltage VINIT.

Figure 5:
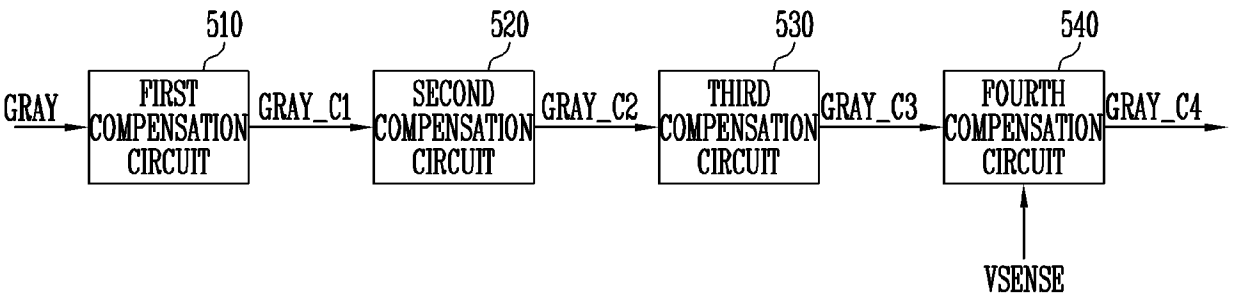
FIG. 5 is a block diagram illustrating an example of a timing controller included in the display device of FIG. 1.

FIG. 5 is a block diagram illustrating an example of the timing controller 140 included in the display device 100 of FIG. 1. FIGS. 6A through 6D are graphs illustrating an example of grayscale-voltage characteristics of a pixel PX compensated by the timing controller 140 of FIG. 1.

Referring to FIGS. 1 and 5, the timing controller 140 may include a first compensation circuit 510 (herein also referred to as a gamma compensation circuit or a digital gamma compensation circuit), a second compensation circuit 520 (herein also referred to as an optical compensation circuit or a deterioration compensation circuit), a third compensation circuit 530 (herein also referred to as a reference grayscale compensation circuit), and a fourth compensation circuit 540 (herein also referred to as an external compensation circuit).

The first compensation circuit 510 may convert an input grayscale value GRAY (herein also referred to as the first grayscale value) into a first grayscale voltage value GRAY_C1 according to a reference gamma curve of the first voltage range. Here, the input grayscale value GRAY may be included in the input image data DATA1 described with reference to FIG. 1. For example, the first compensation circuit 510 may convert the input grayscale value GRAY into the first grayscale voltage value GRAY_C1 according to a 2.2 gamma curve. Here, the first grayscale voltage value GRAY_C1 may be the data value representing the data voltage.

Figure 6A:
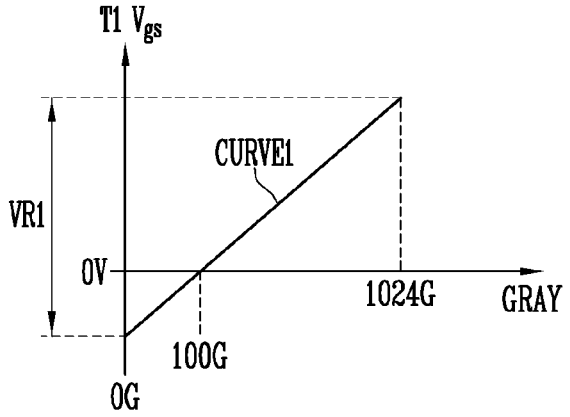
FIG. 6A, FIG. 6B, FIG. 6C, and FIG. 6D are graphs illustrating an example of grayscale-voltage characteristics of a pixel compensated by the timing controller of FIG. 5.

Referring to FIG. 6A, a first curve CURVE1 (or a first graph) indicates a relationship between the input grayscale value GRAY and a gate-source voltage Vgs of the first transistor T1. Here, the gate-source voltage Vgs of the first transistor T1 may represent an operation value obtained by subtracting the initialization voltage VINIT provided to a source electrode (e.g., the second node N2 described with reference to FIG. 2) of the first transistor T1 and the threshold voltage of the first transistor T1 from the data voltage provided to the gate electrode of the first transistor T1. In FIG. 6A, the input grayscale value GRAY has a range from 0G of 0 to a grayscale value 1024G of 1024, but this is merely an example, and the range of the input grayscale value GRAY is not limited thereto.

As the input grayscale value GRAY increases according to the first curve CURVE1, the gate-source voltage Vgs of the first transistor T1 may increase linearly. For example, a plurality of voltage values may be generated by linearly dividing the maximum voltage value and the minimum voltage value of a first voltage range VR1, and the input grayscale value GRAY may correspond to one of the linear voltages.

The gate-source voltage Vgs of the first transistor T1 corresponding to the input grayscale value GRAY in the low grayscale range (e.g., the grayscale value 0G of 0 to a grayscale value 100G of 100) may be smaller than a reference value (e.g., 0V). In this case, with reference to the first characteristic curve CT1 illustrated in FIG. 4, the current corresponding to the input grayscale value GRAY in the low grayscale range (i.e., the driving current flowing through the first transistor T1 of FIG. 2) is 0, and the light emitting element LED may not emit light. The gate-source voltage Vgs of the first transistor T1 corresponding to the input grayscale value GRAY (e.g., the grayscale value 100G of 100 to the grayscale value 1024G of 1024) above the low grayscale range may be greater than the reference voltage.

Figure 6B:
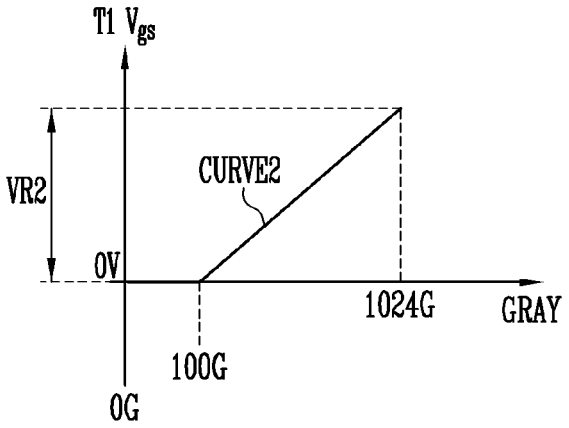

Referring to FIG. 6B, the second curve CURVE2 represents a relationship between the input grayscale value GRAY and the first grayscale voltage value GRAY_C1 (or the gate-source voltage Vgs of the first transistor T1).

According to the second curve CURVE2, the first grayscale voltage value GRAY_C1 (or the gate-source voltage Vgs of the first transistor T1) corresponding to the input grayscale value GRAY (e.g., the grayscale value 0G of 0 to the grayscale value 100G of 100) in the low grayscale range may be converted into the reference voltage (e.g., 0V) or a value similar to the reference voltage. Accordingly, the input grayscale value GRAY in the first voltage range VR1 may be mapped to the first grayscale voltage value GRAY_C1 in a second voltage range VR2.

Referring back to FIG. 5, the second compensation circuit 520 may calculate a second grayscale voltage value GRAY_C2 (or the first voltage value) by adding a compensation value (or a voltage compensation value) to the first grayscale voltage value GRAY_C1. Here, the compensation value may be preset based on a characteristic deviation of the pixel PX in the display unit 110 described with reference to FIG. 1, or may be calculated based on electrical and/or optical deterioration of the pixel PX.

In an embodiment, the second compensation circuit 520 may calculate a compensation value for the first grayscale voltage value GRAY_C1 using at least one of an optical compensation technique, a deterioration compensation technique, and a luminance reduction technique and generate the second grayscale voltage value GRAY_C2 by compensating the first grayscale voltage value GRAY_C1 using the compensation value.

Here, the optical compensation technique (e.g., almost short range uniformity or ASRU) may measure a luminance of the display device 100 (or the display unit 110 of FIG. 1) through a luminance measuring apparatus during a manufacturing and/or inspection process of the display device 100, set and store a compensation value for luminance deviation for each region (or each pixel PX) of the display device 100 based on luminance deviation of the display device 100, and compensate for the voltage value using the previously stored compensation value. In this case, the compensation value may include a gain and an offset indicating a relationship between the grayscale value and the luminance for each region of the display device 100, and may be stored in a memory device in the form of a lookup table.

The deterioration compensation technique (e.g., image sticking compensation or ISC) may accumulate a driving time (and a grayscale value) for each pixel PX to generate stress data (a stress profile or cumulative data), calculate the compensation value based on a predetermined life curve and predetermined stress data, and compensate for the voltage value based on the calculated compensation value. Here, the predetermined life curve may indicate a degree of deterioration of the pixel PX over time, and the compensation value may be stored in a separate lookup table together with the stress data.

The luminance reduction technique (e.g., logo fader or LF) may detect a specific region (e.g., a region corresponding to a logo) having a condition in which deterioration of the display unit 110 is accelerated, and reduce a voltage value corresponding to the detected region by a predetermined ratio or a predetermined value. In contrast, the luminance reduction technique may divide the display unit 110 into a central region and an outer region surrounding the central region, and may reduce the voltage value corresponding to the outer region.

The second compensation circuit 520 may compensate for the first grayscale voltage value GRAY_C1 using various digital compensation techniques such as the optical compensation technique, the deterioration compensation technique, and the luminance reduction technique as described above.

Figure 6C:
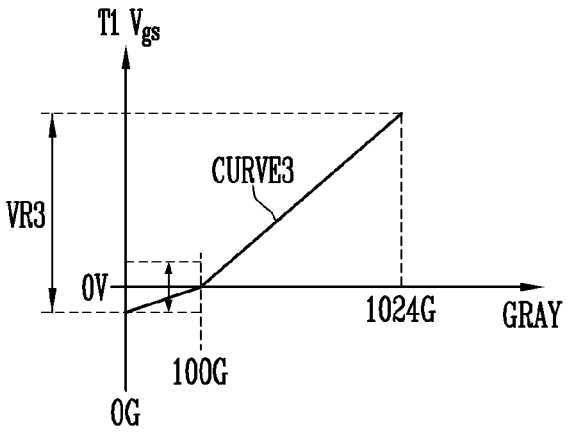

Referring to FIG. 6C, the third curve CURVE3 represents a relationship between the input grayscale value GRAY and the second grayscale voltage value GRAY_C2 (or the gate-source voltage Vgs of the first transistor T1).

According to the third curve CURVE3, the input grayscale value GRAY in the low grayscale range may be corrected to be smaller than the reference voltage (e.g., 0V).

The compensation value (that is, the compensation value calculated using at least one of the optical compensation technique, the deterioration compensation technique, and the luminance reduction technique) may have a negative value or a positive value. Therefore, the second grayscale voltage value GRAY_C2 in the low grayscale range may be smaller than the reference voltage. In this case, the input grayscale value GRAY may be mapped from the first grayscale voltage value GRAY_C1 in the second voltage range VR2 as described with reference to FIG. 6B to the second grayscale voltage value GRAY_C2 in a third voltage range VR3.

When the second grayscale voltage value GRAY_C2 according to the third curve CURVE3 is compensated through the external compensation technique, the input grayscale value GRAY in the low grayscale range (e.g., the third grayscale voltage value GRAY_C3 corresponding to the grayscale value 0G of 0 to the grayscale value 100G of 100, or the gate-source voltage Vgs of the first transistor T1) may be smaller than the reference voltage. That is, a compensation operation using the external compensation technique (that is, a compensation operation of the fourth compensation circuit 540 or a compensation value) may be canceled by the compensation operation (or the compensation value) of the second compensation circuit 520, and the gate-source voltage Vgs having the negative value may be applied to the first transistor T1. In this case, the light emitting element LED may not emit light.

Figure 6D:
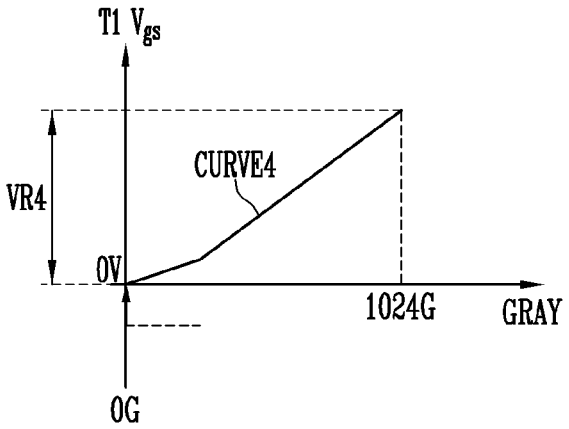

Referring back to FIG. 5, the third compensation circuit 530 may map (or remap) the input grayscale value GRAY from the second grayscale voltage value GRAY_C2 in the third voltage range VR3 to the third grayscale voltage value GRAY_C3 in a fourth voltage range VR4 (refer to FIG. 6D).

In an embodiment, the third compensation circuit 530 may scale the second grayscale voltage value GRAY_C2 in the third voltage range VR3 based on the maximum voltage value and the minimum voltage value of the third voltage range VR3, and shift the scaled second grayscale voltage value to be within the fourth voltage range VR4. For example, the third compensation circuit 530 may map the minimum voltage value of the third voltage range VR3 to a voltage value corresponding to the sum (a total voltage) of the initialization voltage VINIT and the threshold voltage of the first transistor T1.

In another embodiment, the third compensation circuit 530 may remap the input grayscale value GRAY from the second grayscale voltage value GRAY_C2 to the third grayscale voltage value GRAY_C3 using a predetermined lookup table.

Referring to FIG. 6D, the fourth curve CURVE4 represents a relationship between the input grayscale value GRAY and the third grayscale voltage value GRAY_C3 (or the gate-source voltage Vgs of the first transistor T1).

According to the fourth curve CURVE4, the third grayscale voltage value GRAY_C3 may be greater than the reference voltage in an entire range of the input grayscale value GRAY.

Referring to FIGS. 5, 6C and 6D, although an embodiment of remapping from the second grayscale voltage value GRAY_C2 to the third grayscale voltage value GRAY_C3 over the entire range of the input grayscale value GRAY has been described as an example, the operation of the third compensation circuit 530 is not limited thereto. For example, the third compensation circuit 530 may remap from the second grayscale voltage value GRAY_C2 to the third grayscale voltage value GRAY_C3 only in a partial range (e.g., the low grayscale range smaller than the grayscale value 100G of 100) of the input grayscale value GRAY. For example, similar to the second curve CURVE2 illustrated in FIG. 6B, the third compensation circuit 530 may map the input grayscale value GRAY of the partial range (e.g., the low grayscale range smaller than the grayscale value 100G of 100) to a specific voltage (e.g., the sum of the initialization voltage VINIT and the threshold voltage of the first transistor).

Referring back to FIG. 5, the fourth compensation circuit 540 may calculate the fourth grayscale voltage value GRAY_C4 by compensating the third grayscale voltage value GRAY_C3 based on a sensed voltage VSENSE (e.g., the threshold voltage of the first transistor T1).

As described with reference to FIG. 4, the fourth compensation circuit 540 may calculate the fourth grayscale voltage value GRAY_C4 by adding (or subtracting) the threshold voltage (or a voltage value corresponding to the threshold voltage) of the first transistor T1 measured by the sensing unit 150 (refer to FIG. 1) to the third grayscale voltage value GRAY_C3.

The fourth grayscale voltage value GRAY_C4 may be provided to the data driver 130 (refer to FIG. 1), and the data driver 130 may provide the data voltage corresponding to the fourth grayscale voltage value GRAY_C4 to the pixel PX (refer to FIG. 1).

As described with reference to FIGS. 5, 6A, 6B, 6C, and 6D, the timing controller 140 may first compensate for the first grayscale voltage value GRAY_C1 using the deterioration compensation technique to generate the second grayscale voltage value GRAY_C2 (that is, the timing controller 140 may map the input grayscale value GRAY from the first grayscale voltage value GRAY_C1 to the second grayscale voltage value GRAY_C2). Thereafter, the timing controller 140 may convert the second grayscale voltage value GRAY_C2 into the third grayscale voltage value GRAY_C3 within a valid voltage range (that is, the timing controller 140 may remap the input grayscale value GRAY to the third grayscale voltage value GRAY_C3). Thereafter, the timing controller 140 may compensate for the third grayscale voltage value GRAY_C3 using the external compensation technique to generate the fourth grayscale voltage value GRAY_C4. Therefore, the data voltage corresponding to the grayscale values in the low grayscale range can be accurately compensated by the external compensation technique, and the linearity of the light emitting characteristic of the pixel PX in the low grayscale range can be obtained.

Figure 7:
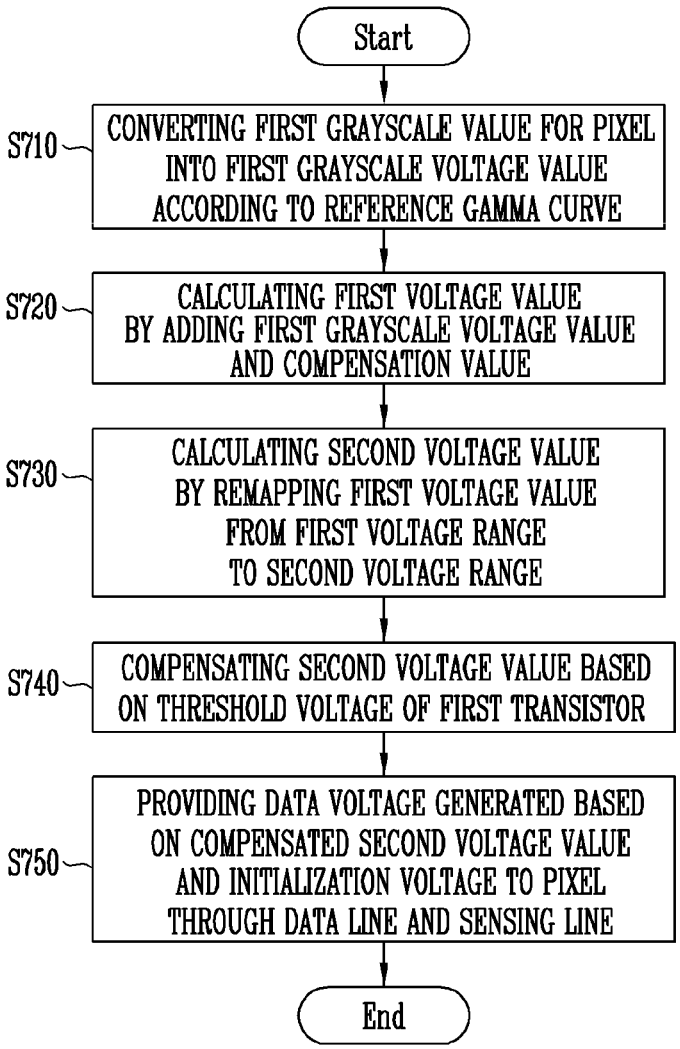
FIG. 7 is a flowchart illustrating an example of performing grayscale voltage compensation according to embodiments of the present disclosure.

FIG. 7 is a flowchart illustrating an example of performing grayscale voltage compensation according to embodiments of the present disclosure.

Referring to FIGS. 1, 4 and 7, the display device 100 may perform the grayscale voltage compensation. For example, the timing controller 140 of FIG. 1 may perform the grayscale voltage compensation.

The display device 100 may convert the first grayscale value (or the input grayscale value GRAY) for the pixel PX into the first grayscale voltage value according to the reference gamma curve (S710). As described with reference to FIGS. 5, 6A, and 6B, the display device 100 may convert the input grayscale value GRAY into the first grayscale voltage value GRAY_C1 in the second voltage range VR2.

The display device 100 may calculate the second grayscale voltage value (or the first voltage value) by adding the first grayscale voltage value and the compensation value (S720). Here, the compensation value may be preset based on a characteristic deviation of the pixel PX or may be calculated based on a level of deterioration of the pixel PX.

As described with reference to FIGS. 5 and 6C, the display device 100 may obtain the compensation value using at least one of the optical compensation technique, the deterioration compensation technique, and the luminance reduction technique, and calculate the second grayscale voltage value GRAY_C2 based on the first grayscale voltage value GRAY_C1 and the compensation value.

The display device 100 may calculate the third grayscale voltage value (or the second voltage value) by remapping the second grayscale voltage value from the third voltage range (or the first voltage range) to the fourth voltage range (or the second voltage range) (S730). As described with reference to FIGS. 5 and 6D, the display device 100 may remap the second grayscale voltage value GRAY_C2 in the third voltage range VR3 to the third grayscale voltage value GRAY_C3 in the fourth voltage range VR4 based on the minimum voltage value and the maximum voltage value of the third voltage range VR3.

The voltage difference between the data voltage corresponding to the third grayscale voltage value GRAY_C3 in the fourth voltage range VR4 and the threshold voltage of the first transistor T1 may be greater than or equal to the initialization voltage VINIT (refer to FIGS. 2 and 3). In an embodiment, the gate-source voltage of the first transistor T1 may be greater than 0V over the entire range of the input grayscale value GRAY.

Subsequently, the display device 100 may compensate for the third grayscale voltage value GRAY_C3 (or the second voltage value) based on the threshold voltage of the first transistor T1 (S740). As described with reference to FIGS. 4 and 5, the display device 100 may compensate for the third grayscale voltage value GRAY_C3 based on the compensation value corresponding to the threshold voltage of the first transistor T1 that is sensed by the sensing unit 150.

The display device 100 may provide the data voltage generated based on the compensated third grayscale voltage value GRAY_C3 (that is, the fourth grayscale voltage value GRAY_C4 described with reference to FIG. 5, or a compensated second voltage value) and the initialization voltage VINIT to the pixel PX through the data line and the sensing line, respectively (S750). As described with reference to FIGS. 2 and 3, the display device 100 may provide the data signal to the data line and may simultaneously provide the initialization voltage VINIT to the sensing line.

According to the embodiments of the present disclosure, a display device and a method of driving the display device may compensate for the grayscale value (or the data signal) using a deterioration compensation technique, and remap the compensated grayscale value (or the compensated data signal) from the first voltage range to the second voltage range so that the voltage difference between the data voltage corresponding to the minimum grayscale value and the threshold voltage of the driving transistor is equal to the initialization voltage. Therefore, compensation by the external compensation technique can be maintained, and the linearity of the light emitting characteristic of the pixel in the low grayscale range can be obtained.

The scope of the present disclosure is not limited to the example embodiments described herein. In addition, it is to be construed that changes or modifications derived from the meaning and scope of the claims and equivalent concepts thereof are included in the scope of the present disclosure.

What is claimed is:

1. A display device comprising:

a display unit including a data line, a sensing line, and a pixel connected to the data line and the sensing line, the pixel including a light emitting element and a first transistor for providing a driving current to the light emitting element;

a timing controller generating a first voltage value by compensating a first grayscale value and generating a second voltage value by remapping the first voltage value;

a data driver generating a data voltage based on the second voltage value and supplying the data voltage to the data line in a display period; and a sensing unit providing an initialization voltage to the sensing line in the display period and sensing a threshold voltage of the first transistor through the sensing line in a sensing period, wherein the timing controller remaps the first voltage value that is in a first voltage range to the second voltage value that is in a second voltage range by shifting a minimum voltage value of the first voltage range to a voltage value corresponding to a sum of the initialization voltage and the threshold voltage of the first transistor.

2. The display device of claim 1, wherein the second voltage range is a subset of the first voltage range.

3. The display device of claim 2, wherein a minimum voltage value of the second voltage range is greater than the minimum voltage value of the first voltage range, and wherein a maximum voltage value of the second voltage range is equal to a maximum voltage value of the first voltage range.

4. The display device of claim 3, wherein a voltage greater than or equal to zero is applied between a gate electrode and a source electrode of the first transistor according to the data voltage.

5. The display device of claim 1, wherein for the first grayscale value being a minimum grayscale value corresponding to a black color, a voltage difference between the data voltage with respect to the first grayscale value and the threshold voltage of the first transistor is greater than or equal to the initialization voltage.

6. The display device of claim 5, wherein the pixel further includes:

a second transistor connected between the data line and a first node;

a storage capacitor connected between the first node and a second node; and a third transistor connected between the second node and the sensing line, wherein an electrode of the light emitting element is connected to the second node, and wherein the first transistor provides the driving current to the second node in response to a voltage of the first node.

7. The display device of claim 6, wherein the first transistor includes an oxide semiconductor.

8. The display device of claim 1, wherein the timing controller includes:

a first compensation circuit converting the first grayscale value to a first grayscale voltage value according to a reference gamma curve;

a second compensation circuit calculating the first voltage value by adding the first grayscale voltage value and a compensation value; and a third compensation circuit calculating the second voltage value by remapping the first voltage value from the first voltage range to the second voltage range, wherein the compensation value is preset based on a characteristic deviation of the pixel or calculated based on a level of deterioration of the pixel.

9. The display device of claim 8, wherein the compensation value is smaller than zero, and wherein the first voltage value is smaller than the first grayscale voltage value.

10. The display device of claim 8, wherein the third compensation circuit scales the first voltage value and shifts a scaled first voltage value within the second voltage range.

11. The display device of claim 10, wherein the third compensation circuit maps the minimum voltage value of the first voltage range to the voltage value corresponding to the sum of the initialization voltage and the threshold voltage of the first transistor.

12. The display device of claim 8, wherein the third compensation circuit remaps the first voltage value to the second voltage value using a lookup table.

13. A display device comprising:

a display unit including a data line, a sensing line, and a pixel connected to the data line and the sensing line, the pixel including a light emitting element and a transistor for providing a driving current to the light emitting element;

a timing controller generating a first voltage value by compensating a first grayscale value and generating a second voltage value by remapping the first voltage value;

a data driver generating a data voltage based on the second voltage value and supplying the data voltage to the data line; and a sensing unit providing an initialization voltage to the sensing line, wherein the timing controller remaps the first voltage value that is in a first voltage range to the second voltage value that is in a second voltage range by shifting a minimum voltage value of the first voltage range to a voltage value corresponding to a sum of the initialization voltage and a threshold voltage of the transistor.

14. The display device display device of claim 13, wherein the sensing unit senses the threshold voltage of the transistor through the sensing line in a sensing period.

15. A method of driving a display device, wherein the display device includes a data line, a sensing line, and a pixel connected to the data line and the sensing line, and wherein the pixel includes a light emitting element and a transistor for providing a driving current to the light emitting element, the method comprising:

converting a first grayscale value for the pixel into a first grayscale voltage value according to a reference gamma curve;

calculating a first voltage value by adding the first grayscale voltage value and a compensation value;

calculating a second voltage value by remapping the first voltage value from a first voltage range to a second voltage range; and providing an initialization voltage to the pixel through the sensing line and a data voltage that is generated based on the second voltage value to the pixel through the data line, wherein the compensation value is preset based on a characteristic deviation of the pixel or calculated based on a level of deterioration of the pixel, and wherein the calculating the second voltage value includes remapping the first voltage value to the second voltage value by shifting a minimum voltage value of the first voltage range to a voltage value corresponding to a sum of the initialization voltage and a threshold voltage of the transistor.

16. The method of driving a display device of claim 15, further comprising:

sensing the threshold voltage of the transistor through the sensing line in a sensing period.

* * * * *